United States Patent [19]

Shea

[11] 4,201,438

[45] May 6, 1980

[54] SPRING CONTACT FOR ARC DISCHARGE TUBE BASE

[75] Inventor: Richard J. Shea, Danvers, Mass.

[73] Assignee: GTE Sylvania Incorporated, Stamford, Conn.

[21] Appl. No.: 947,668

[22] Filed: Oct. 2, 1978

[51] Int. Cl.[2] ..... H01J 5/50

[52] U.S. Cl. ..... 339/144 R; 313/318

[58] Field of Search ..... 339/144 R, 144 T; 313/318

[56] References Cited

U.S. PATENT DOCUMENTS

| | | | |
|---|---|---|---|
| 2,465,414 | 3/1949 | Abshire | 339/144 R |
| 4,130,774 | 12/1978 | Cosco et al. | 313/318 |

OTHER PUBLICATIONS

Wittenberg et al., Strain Isolating Vacuum Tube Terminal, RCA Technical Note No. 63, Radio Corp. of America (12-1957).

*Primary Examiner*—Roy Lake
*Assistant Examiner*—Eugene F. Desmond
*Attorney, Agent, or Firm*—James Theodosopoulos

[57] ABSTRACT

An arc tube has a metal end cap at its end, electrically connected to an electrode in the arc tube. The end cap has a bowed spring contact fastened thereto which is the support means and the electrical connection means for the arc tube when it is inserted into a socket.

1 Claim, 2 Drawing Figures

SPRING CONTACT FOR ARC DISCHARGE TUBE BASE

THE INVENTION

This invention is concerned with xenon arc discharge flash tubes. An example of such a flash tube is shown in U.S. Pat. No. 3,868,182. It is particularly concerned with the metal end caps at the ends of the flash tube which are inserted into sockets to support the flash tube and to provide electrical connection thereto. A typical end cap is shown in U.S. Pat. No. 4,004,189.

In the prior art, the sockets contained metal spring-type contacts to make contact with the end caps of the flash tube. A problem with such sockets is that after a period of time, the spring contacts lose some of their springiness. Thus, replacement of the flash tubes, after they reach end of life, could become progressively more difficult and a point could be reached where some of the flash tubes could be broken when trying to insert them into the sockets.

This invention solves the problem by providing a spring-type contact on the end cap. This eliminates the need for spring contacts in the socket and eliminates the aging problem that is associated therewith. When a flash tube has to be replaced, the replacement tube carries its own unaged spring contact.

Figure 1:
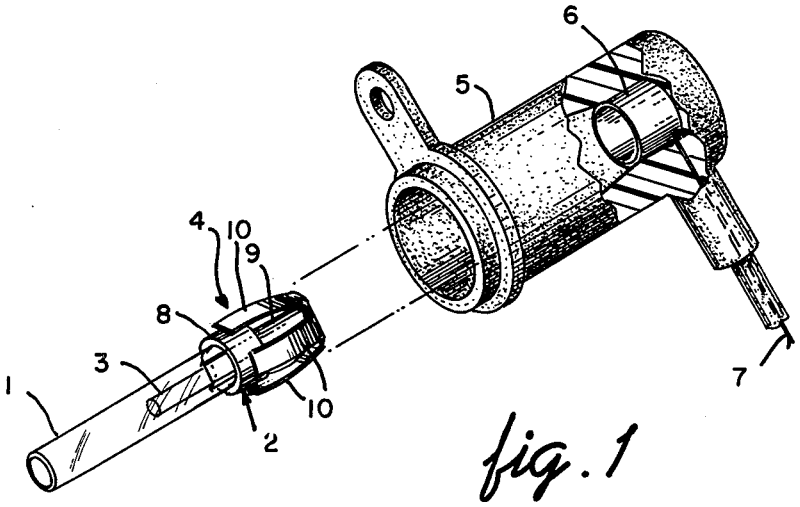
Figure 2:
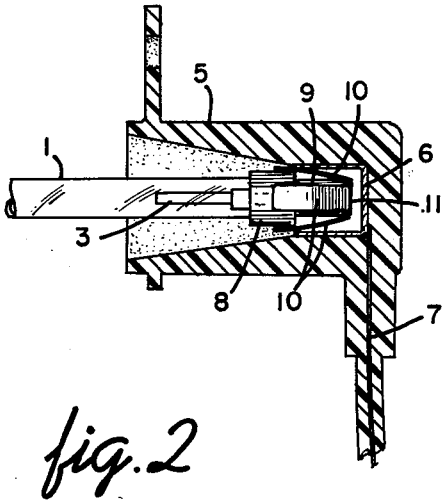

In the drawing, FIG. 1 is an exploded, partly sectional view of a flash tube end and the socket into which it is inserted. FIG. 2 is a sectional view showing said end in said socket.

One embodiment of a flashtube in accordance with this invention comprised a glass tube 1 having an external metal end cap 2 at its end. An internal electrode 3 was connected to end cap 2. End cap 2 comprised a larger diameter shoulder portion 8, which fit around the end of tube 1 and was cemented thereto, and a smaller diameter terminal portion 9. A metal spring-type contact 4 was fastened to terminal portion 9 of end cap 2. Contact 4 had a bowed basket construction with the smallest diameter at the end to provide for ready insertion into a socket and to provide compression of contact 4 after full insertion into the socket. The socket comprised a tubular plastic case 5 the inside of which was tapered. At the bottom, a metal shell 6 was molded therein and an externally protruding lead-in wire 7 was connected to shell 6.

In one example, glass tube 1 was $\frac{1}{4}''$ diameter. End cap 2 was $\frac{5}{8}''$ long, with shoulder 8 being $\frac{3}{8}''$ diameter by $\frac{1}{4}''$ long and terminal portion 9 being $\frac{1}{4}''$ diameter by $\frac{5}{8}''$ long. Contact 4 was made of 10 mil thick spring tempered phosphor bronze and comprised four bowed arms 10 protruding from a center 11. Each arm 10 was 3/16" wide by $\frac{1}{2}''$ long. Center 11 was fastened, such as by soldering, to the end of terminal portion 9. The diameter formed by the four arms 10 at the point of maximum bowing, which was about $\frac{1}{4}''$ from center 11, was 510 mils. The ends of arms 10 extended to shoulder 8 but did not make contact therewith in their unstressed state. The diameter of shell 6 was such that when contact 4 was inserted therein, the free ends of each of arms 4 were pressed against shoulder 8, and each arm 4 was additionally compressed beyond that. This insured good electrical connection and a secure fit of contact 4 in shell 6.

I claim:

1. An arc discharge tube having a metal end cap at its end electrically connected to a discharge electrode in the arc tube, the end cap having a bowed spring contact fastened thereto, the spring contact being the support means and the electrical connection means for the arc tube when it is inserted into a socket, the end cap comprising a larger diameter shoulder and a smaller diameter terminal portion, said shoulder fitting over the end of the arc tube and being cemented thereto, the spring contact being fastened to the end of said terminal portion, said spring contact comprising arms extending from a center portion, the center portion being fastened to the end of said terminal portion, said arms forming a basket around the end cap and extending to the shoulder thereof but being spaced therefrom, the largest diameter of said basket being about midway between the shoulder and the terminal portion end, wherein said arms can be pressed into contact with said shoulder, and can be compressed further, when the end cap is inserted into a suitable socket.

* * * * *